US006932453B2

(12) United States Patent
Feinn et al.

(10) Patent No.: US 6,932,453 B2
(45) Date of Patent: Aug. 23, 2005

(54) INKJET PRINTHEAD ASSEMBLY HAVING VERY HIGH DROP RATE GENERATION

(75) Inventors: James A. Feinn, San Diego, CA (US); Winthrop D. Childers, San Diego, CA (US); Michael J. Barbour, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 49 days.

(21) Appl. No.: 09/999,355

(22) Filed: Oct. 31, 2001

(65) Prior Publication Data

US 2003/0081028 A1 May 1, 2003

(51) Int. Cl.[7] ..... B41J 29/38

(52) U.S. Cl. ..... 347/12; 347/57; 347/59; 347/9

(58) Field of Search ..... 347/9, 10, 11, 347/15, 42, 43, 12, 59, 57

(56) References Cited

U.S. PATENT DOCUMENTS

| | | | | |
|---|---|---|---|---|
| 4,463,359 A | | 7/1984 | Ayata et al. | 346/1.1 |
| 4,595,935 A | | 6/1986 | Brooks et al. | 346/76 PH |
| 4,695,853 A | | 9/1987 | Hackleman et al. | 346/140 R |
| 4,695,854 A | | 9/1987 | Cruz-Uribe | 346/140 R |
| 4,719,477 A | | 1/1988 | Hess | 346/140 R |
| 4,737,800 A | * | 4/1988 | Caillol et al. | 346/76 |
| 4,764,659 A | | 8/1988 | Minami et al. | 219/216 |
| 4,914,562 A | | 4/1990 | Abe et al. | |
| 4,982,199 A | | 1/1991 | Dunn | 346/1.1 |
| 4,999,650 A | | 3/1991 | Braun | 346/140 R |
| 5,016,023 A | | 5/1991 | Chan et al. | 346/1.1 |
| 5,030,971 A | | 7/1991 | Drake et al. | 346/140 R |
| 5,049,898 A | | 9/1991 | Arthur et al. | 346/1.1 |
| 5,103,246 A | | 4/1992 | Dunn | 346/140 R |
| 5,327,165 A | | 7/1994 | Elliott | 346/76 PH |
| 5,363,134 A | | 11/1994 | Barbehenn et al. | 347/49 |
| 5,365,312 A | | 11/1994 | Hillmann et al. | 355/206 |
| 5,371,530 A | | 12/1994 | Hawkins et al. | 347/9 |
| 5,412,410 A | * | 5/1995 | Rezanka | 347/15 |
| 5,534,895 A | * | 7/1996 | Lindenfelser et al. | 347/19 |
| 5,541,629 A | | 7/1996 | Saunders et al. | 347/12 |
| 5,604,513 A | | 2/1997 | Takahashi et al. | 345/153 |
| 5,610,635 A | | 3/1997 | Murray et al. | 347/7 |
| 5,638,101 A | | 6/1997 | Keefe et al. | |
| 5,646,660 A | | 7/1997 | Murray | 347/59 |
| 5,648,804 A | | 7/1997 | Keefe et al. | 347/47 |
| 5,648,806 A | | 7/1997 | Steinfield et al. | |
| 5,666,140 A | * | 9/1997 | Mitani et al. | 347/12 |

(Continued)

FOREIGN PATENT DOCUMENTS

| | | | | |
|---|---|---|---|---|
| EP | 0547921 B1 | | 6/1993 | B41J/2/175 |
| EP | 0193257 A2 | * | 5/1999 | |
| EP | 0997281 | | 5/2000 | |
| EP | 1022148 | | 7/2000 | |
| EP | 1078753 A2 | | 2/2001 | |
| EP | 1080898 | | 3/2001 | |
| JP | 8-216435 | | 8/1996 | |
| WO | WO0121407 | | 3/2001 | |

OTHER PUBLICATIONS

EP Search Report dated Mar. 5, 2004.
A copy of European Search Report for Application No. EP 02 25 7312 mailed on Jul. 30, 2003 (4 pages).

*Primary Examiner*—Hai Pham
*Assistant Examiner*—Lam S Nguyen

(57) ABSTRACT

An inkjet printhead assembly includes at least one inkjet printhead including N primitives and an address having M possible address values. Each primitive includes a group of at most M drop generators. The address is cycled through all M address values to control a sequence of which one drop generator in the primitive is fired at a given time. One drop generator in the primitive can be fired simultaneously with one drop generator in each of the other primitives. A primitive to address ratio (N/M) of the printhead is at least 10 to 1.

11 Claims, 9 Drawing Sheets

U.S. PATENT DOCUMENTS 5,697,144 A 12/1997 Mitani et al.
5,742,305 A * 4/1998 Hackleman ..... 347/42
5,742,307 A * 4/1998 Watrobski et al. ..... 347/62
5,815,172 A 9/1998 Moh ..... 347/14
5,815,180 A 9/1998 Barbour et al. ..... 347/59
5,859,655 A 1/1999 Gelorme et al.
5,886,718 A 3/1999 Johnson et al. ..... 347/85
5,946,012 A 8/1999 Courian et al. ..... 347/63
5,984,455 A * 11/1999 Anderson ..... 347/47
6,000,787 A 12/1999 Weber ..... 347/65
6,091,891 A 7/2000 Overall et al. ..... 395/112
6,109,716 A 8/2000 Takahashi ..... 347/11
6,126,261 A 10/2000 Yamanaka ..... 347/12
6,130,694 A * 10/2000 Beatty ..... 347/58
6,139,131 A * 10/2000 Prasad et al. ..... 347/63
6,176,569 B1 1/2001 Anderson et al. ..... 347/57
6,178,009 B1 1/2001 Yamada et al. ..... 358/1.9
6,186,616 B1 2/2001 Inoue et al.
6,193,345 B1 2/2001 Feinn et al. ..... 347/12
6,361,156 B1 * 3/2002 Romano, Jr. et al. ..... 347/82

* cited by examiner

INKJET PRINTHEAD ASSEMBLY HAVING VERY HIGH DROP RATE GENERATION

CROSS-REFERENCE TO RELATED APPLICATIONS

This Non-Provisional Patent Application is related to the following commonly assigned U.S. patent applications: Ser. No. 09/253,411, filed on Feb. 19, 1999, entitled "A HIGH PERFORMANCE PRINTING SYSTEM AND PROTOCOL," Ser. No. 09/798,330, filed on Mar. 2, 2001, entitled "PROGRAMMABLE NOZZLE FIRING ORDER FOR INKJET PRINTHEAD ASSEMBLY," Ser. No. 09/808,763, filed on Mar. 15, 2001, entitled "INTEGRATED CONTROL OF POWER DELIVERY TO FIRING RESISTORS FOR INKJET PRINTHEAD ASSEMBLY," Ser. No. 09/876,470, filed on Jun. 6, 2001, entitled "PRINTHEAD WITH HIGH NOZZLE PACKING DENSITY," and Ser. No. 08/702,104 filed on Aug. 28, 1996, entitled "INKJET PRINTHEAD ASSEMBLY HAVING VERY HIGH NOZZLE PACKING DENSITY", all of which are herein incorporated by reference. This Non-Provisional patent application is also related to commonly assigned U.S. Pat. No. 6,193,345, which is herein incorporated by reference.

THE FIELD OF THE INVENTION

The present invention relates generally to inkjet printheads, and more particularly to inkjet printheads having very high drop rate generation.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

Typically, the printhead ejects the ink drops through the nozzles by rapidly heating a small volume of ink located in vaporization chambers with small electric heaters, such as thin film resisters. Heating the ink causes the ink to vaporize and be ejected from the nozzles. Typically, for one dot of ink, a remote printhead controller typically located as part of the processing electronics of a printer, controls activation of an electrical current from a power supply external to the printhead. The electrical current is passed through a selected thin film resister to heat the ink in a corresponding selected vaporization chamber. The thin film resistors are herein also referred to as firing resistors. A drop generator is herein referred to include a nozzle, a vaporization chamber, and a firing resistor.

Inkjet printhead evolution has increased the number of drop generators per printhead resulting in an improved printhead drop generation rate. The increase in the number of drop generators per printhead has resulted in a corresponding increase in the number of input pads required on a printhead die to energize the corresponding increase in number of firing resistors. One previous type of printhead has 50 drop generators and 50 power input pads to provide power to separate leads each energizing one of the corresponding firing resistors. This type of printhead, however, is impractical to implement above approximately 50 drop generators.

The required number of input pads is significantly reduced in another conventional type of printhead having switching devices, such as field effect transistors (FETs), coupled to each firing resistor to control the application of the electrical current through the selected firing resistors. In one printhead arrangement, the firing resistors are grouped together into primitives, with a single power lead providing power to the source or drain of each corresponding FET for each firing resistor in a primitive. Each FET in a primitive has a separately energizable address lead coupled to its gate, with each address lead shared by multiple primitives. In a typical printing operation, the address leads are controlled so that only a single firing resistor in a primitive is activated at a given time.

In one arrangement, the address lead coupled to the gate of each FET is controlled by a combination of nozzle data, nozzle addresses, and a fire pulse. The nozzle data is typically provided by the electronic controller of the printer and represents the actual data to be printed. The fire pulse controls the timing of the activation of the electrical current through the selected firing resistor. Typical conventional inkjet printing systems employ the electronic controller to control the timing related to the fire pulse. The nozzle address is cycled through all nozzle addresses to control the nozzle firing order so that all nozzles can be fired, but only a single nozzle in a primitive is fired at a given time.

The number of primitives defines the number of drop generators which can be fired at a given time. The number of address leads per primitive defines the number of firing cycles required to fire all drop generators in the printhead. If there are N primitive leads and M address leads, the N primitive leads and M address leads plus a ground lead can service N×M firing resistors. The total number of input leads (i.e., N+M) is minimized when N=M. The ratio of N/M is herein referred to as the primitive to address ratio of the printhead.

One type of printhead, such as described in the above-incorporated Patent Application entitled "A HIGH PERFORMANCE PRINTING SYSTEM AND PROTOCOL," employs integrated de-multiplexing electronics to receive and process serial print data. In such a printhead, the serial print data is transmitted to the printhead over a high speed serial interface. A serial shift register in the printhead converts serial, multiplexed print data into parallel print data for a firing array of drop generators (i.e., the serial shift register performs a first level of de-multiplexing). The serial shift register provides parallel data to data latches which hold the parallel data constant throughout the firing period for each address selection. In this manner, while one column of nozzles is firing, the shift register is free to bring in print data for the next nozzle column. This type of printhead can include a second level of de-multiplexing which combines the data from the data latches with the address lines to control the gates of corresponding FETs coupled to corresponding firing resistors to control the application of the electrical current through the selected firing resistors. In this arrangement, the FET is capable of switching high firing current directly on the printhead which eliminates the need and expense for external power switching required when a data line is connected directly to the firing resistor and strobbed externally. As the firing frequency and the number of nozzles increase in this type of printhead, the serial channel data rate and/or the number of data input lines must also increase.

With the primitive to address ratio equal to approximately one, printheads typically function satisfactory when the total drop generator count is not very high (e.g., below approximately 400 drop generators per color of ink) and the firing frequency is not very high (e.g., substantially less than 18 Khz). However, with the firing frequency of a printhead very high (e.g., above approximately 18 Khz), the number of address leads is typically limited to a maximum number (e.g., approximately 10 to 15 address leads), because the higher firing rate limits the number of address strobes (i.e., nozzle firings) which can fit within the shortened firing cycle. With an example primitive to address ratio equal to one, the limitation of 10 to 15 address leads correspondingly results in printheads with only approximately 100 to 225 drop generators.

For reasons stated above and for other reasons presented in greater detail in the Description of the Preferred Embodiments section of the present specification, an inkjet printhead is desired which has a relatively very high number of drop generators (e.g., 1000 or more drop generators) that operate at very high frequencies (e.g., frequencies above 18 Khz).

SUMMARY OF THE INVENTION

One aspect of the present invention provides an inkjet printhead including N primitives and an address having M possible address values. Each primitive includes a group of at most M drop generators. The address is cycled through all M address values to control a sequence of which one drop generator in the primitive is fired at a given time. One drop generator in the primitive can be fired simultaneously with one drop generator in each of the other primitives. A primitive to address ratio (N/M) of the printhead is at least 10 to 1.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
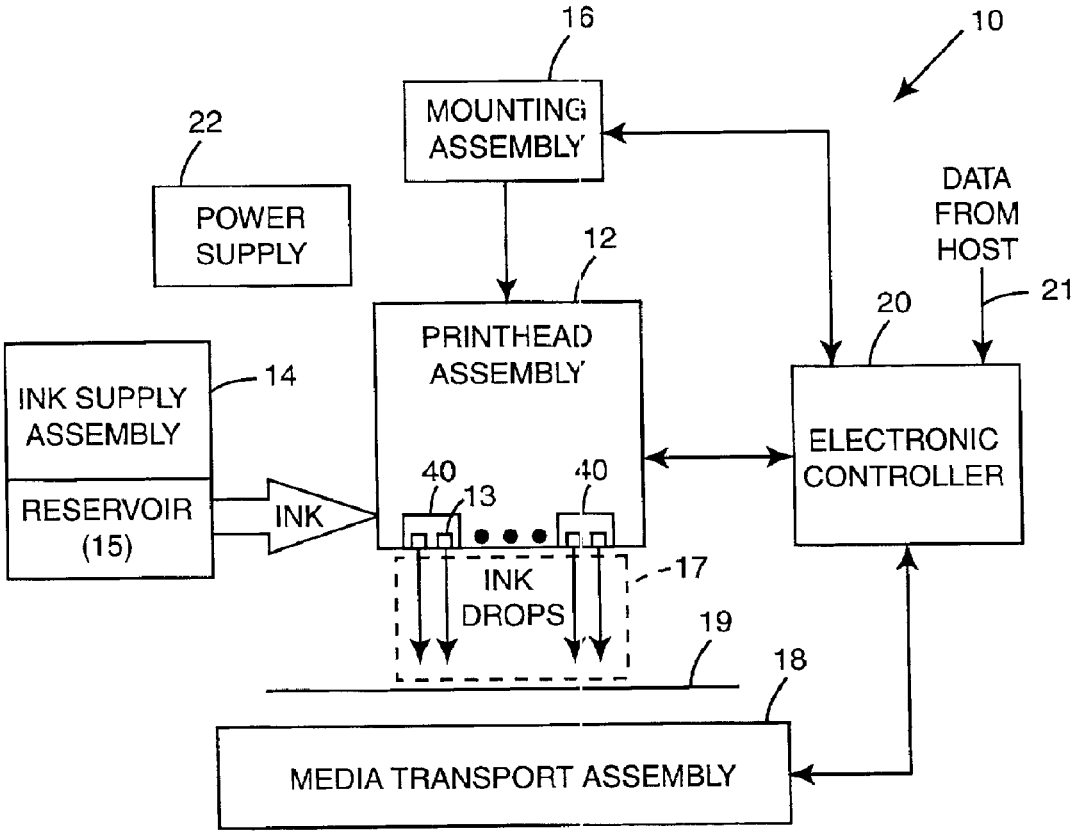
FIG. 1 is a block diagram illustrating one embodiment of an inkjet printing system.

FIG. 1 illustrates one embodiment of an inkjet printing system 10. Inkjet printing system 10 includes an inkjet printhead assembly 12, an ink supply assembly 14, a mounting assembly 16, a media transport assembly 18, and an electronic controller 20. At least one power supply 22 provides power to the various electrical components of inkjet printing system 10. Inkjet printhead assembly 12 includes at least one printhead or printhead die 40 which ejects drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, electronic controller 20 controls inkjet printhead assembly 12 for ejection of ink drops from nozzles 13. As such, electronic controller 20 defines a pattern of ejected ink drops which form characters, symbols, and/or other graphics or images on print medium 19. The pattern of ejected ink drops is determined by the print job commands and/or command parameters.

In one embodiment, inkjet printhead assembly 12 includes one printhead 40. In another embodiment, inkjet printhead assembly 12 is a wide-array or multi-head printhead assembly. In one wide-array embodiment, inkjet printhead assembly 12 includes a carrier, which carries printhead dies 40, provides electrical communication between printhead dies 40 and electronic controller 20, and provides fluidic communication between printhead dies 40 and ink supply assembly 14.

Figure 2:
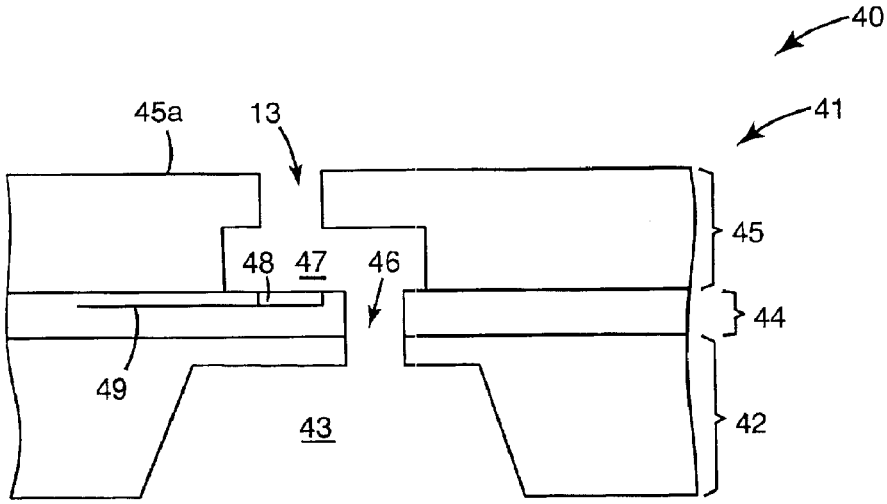
FIG. 2 is an enlarged schematic cross-sectional view illustrating portions of one embodiment of a printhead die in the printing system of FIG. 1.

A portion of one embodiment of a printhead die 40 is illustrated schematically in FIG. 2. Printhead die 40 includes an array of printing or drop ejecting elements (i.e., drop generators) 41. Printing elements 41 are formed on a substrate 42 which has an ink feed slot 43 formed therein. As such, ink feed slot 43 provides a supply of liquid ink to printing elements 41. Each printing element 41 includes a thin-film structure 44, an orifice layer 45, and a firing resistor 48. Thin-film structure 44 has an ink feed channel 46 formed therein which communicates with ink feed slot 43 formed in substrate 42. Orifice layer 45 has a front face 45*a* and a nozzle opening 13 formed in front face 45*a*. Orifice layer 45 also has a nozzle chamber or vaporization chamber 47 formed therein which communicates with nozzle opening 13 and ink feed channel 46 of thin-film structure 44. Firing resistor 48 is positioned within nozzle chamber 47. Leads 49 electrically couple firing resistor 48 to circuitry controlling the application of electrical current through selected firing resistors.

During printing, ink flows from ink feed slot 43 to nozzle chamber 47 via ink feed channel 46. Nozzle opening 13 is operatively associated with firing resistor 48 such that droplets of ink within nozzle chamber 47 are ejected through nozzle opening 13 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 42 is formed, for example, of silicon, glass, or a stable polymer and thin-film structure 44 is formed by one or more passivation or insulation layers of silicon dioxide, silicon carbide, silicon nitride, tantalum, poly-silicon glass, or other suitable material. Thin-film structure 44 also includes a conductive layer which defines firing resistor 48 and leads 49. The conductive layer is formed, for example, by aluminum, gold, tantalum, tantalum-aluminum, or other metal or metal alloy.

Printhead assembly 12 can include any suitable number (P) of printheads 40, where P is at least one. Before a print operation can be performed, data must be sent to printhead 40. Data includes, for example, print data and non-print data for printhead 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

Figure 3:
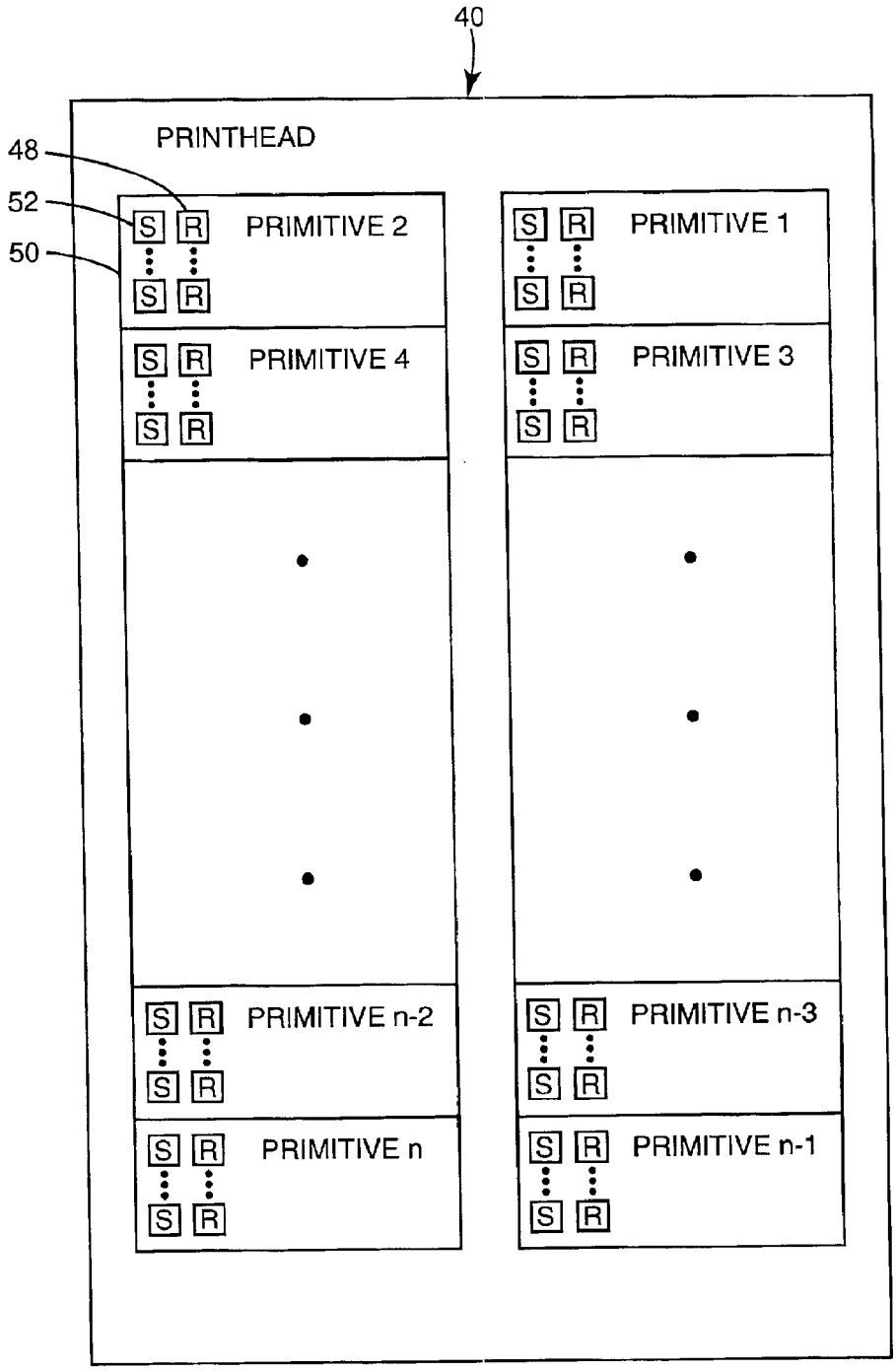
FIG. 3 is a block diagram illustrating portions of one embodiment of an inkjet printhead having firing resistors grouped together into primitives.

One embodiment of printhead 40 is illustrated generally in block diagram form in FIG. 3. Printhead 40 includes multiple firing resistors 48 which are grouped together into primitives 50. As illustrated in FIG. 3, printhead 40 includes N primitives 50. The number of firing resistors 48 grouped in a given primitive can vary from primitive to primitive or can be the same for each primitive in printhead 40. Each firing resistor 48 has an associated switching device 52, such as a field effect transistor (FET). A single power lead provides power to the source or drain of each FET 52 for each resistor in each primitive 50. Each FET 52 in a primitive 50 is controlled with a separately energizable address lead coupled to the gate of the FET 52. Each address lead is shared by multiple primitives 50. As described in detail below, the address leads are controlled so that only one FET 52 is switched on at a given time so that only a single firing resistor 48 has electrical current passed through it to heat the ink in a corresponding selected vaporization chamber at the given time.

In the embodiment illustrated in FIG. 3, primitives 50 are arranged in printhead 40 in two columns of N/2 primitives per column. Other embodiments of printhead 40, however, have primitives arranged in many other suitable arrangements. An example primitive arrangement which permits a very high nozzle packing density is described below with reference to FIG. 7.

Figure 4:
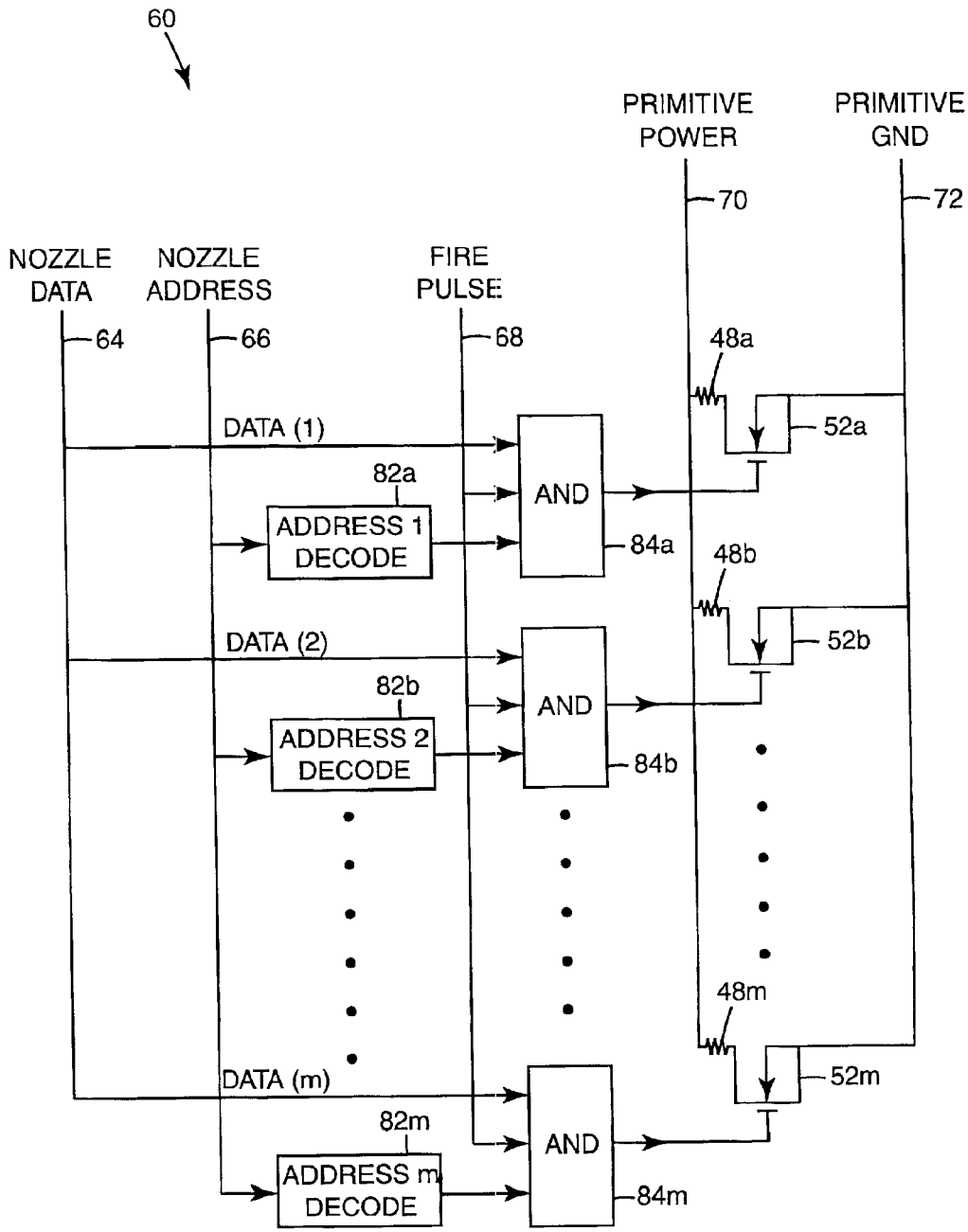
FIG. 4 is a block and schematic diagram illustrating portions of one embodiment of nozzle drive logic and circuitry employable in a primitive of an inkjet printhead.

Portions of one embodiment of nozzle drive logic and circuitry 60 of a primitive 50 are generally illustrated in block and schematic diagram form in FIG. 4. The portions illustrated in FIG. 4 represent the main logic and circuitry for implementing the nozzle firing operation of nozzle drive logic and circuitry 60. However, practical implementations of nozzle drive logic and circuitry 60 can include various other complex logic and circuitry not illustrated in FIG. 4.

Nozzle drive logic and circuitry 60 receives nozzle data on a path 64, a nozzle address on a path 66, and a fire pulse on a path 68. Nozzle drive logic and circuitry 60 also receives primitive power on a power line 70 and primitive ground on a ground line 72. Nozzle drive logic and circuitry 60 combines the nozzle data on path 64, the nozzle address on path 66, and the fire pulse on path 68 to sequentially switch electrical current from primitive power line 70 through firing resistors 48 to ground line 72. The nozzle data on path 64 represents the characters, symbols, and/or other graphics or images to be printed. The nozzle address on path 66 has M possible address values which control the sequence of which nozzle is to be fired at a given time (i.e., the nozzle firing order). The nozzle address on path 66 is cycled through all M address values so that all nozzles can be fired, but only a single firing resistor 48 in primitive 50 is operated at a given time. The fire pulse on path 68 controls the timing of the activation of the electrical current from a power supply external to the printhead, such as power supply 22 (shown in FIG. 1).

In the embodiment of nozzle drive logic and circuitry 60 illustrated in FIG. 4, the nozzle address provided on path 66 is an encoded address. Thus, the nozzle address on path 66 is provided to M address decoders 82*a*, 82*b*, . . . , 82*m*. In this embodiment, the nozzle address on path 66 can represent one of M address values representing one of M' nozzles in the primitive 50 wherein M' is at most M. Accordingly, the address decoders 82 respectively provide an active output signal if the nozzle address on path 66 represents the nozzle associated with a given address decoder.

Nozzle drive logic and circuitry 60 includes AND gates 84*a*, 84*b*, . . . , 84*m*, which receive the M outputs from the address decoders 82*a*–82*m*. AND gates 84*a*–84*m* also respectively receive corresponding ones of the M nozzle data bits from path 64. AND gates 84*a*–84*m* also each receive the fire pulse provided on path 68. The outputs of AND gates 84*a*–84*m* are respectively coupled to corresponding control gates of FETs 52*a*–52*m*. Thus, for each AND gate 84, if the corresponding nozzle 13 has been selected to receive data based on the nozzle data input bit from path 64, the fire pulse on line 68 is active, and the nozzle address on line 66 matches the address of the corresponding nozzle, the AND gate 84 activates its output which is coupled to the control gate of a corresponding FET 52.

Each FET 52 has its source coupled to primitive ground line 72 and its drain coupled to a corresponding firing resistor 48. Firing resistors 48*a*–48*m* are respectively coupled between primitive power line 70 and the drains of corresponding FETs 52*a*–52*m*.

Thus, when the combination of the nozzle data bit, the decoded address bit, and the fire pulse provide three active inputs to a given AND gate 84, the given AND gate 84 provides an active pulse to the control gate of the corresponding FET 52 to thereby turn on the corresponding FET 52 which correspondingly causes current to be passed from primitive power line 70 through the selected firing resistor 48 to primitive ground line 72. The electrical current being passed through the selected firing resistor 48 heats the ink in a corresponding selected vaporization chamber to cause the ink to vaporize and be ejected from the corresponding nozzle 13.

Figure 5:
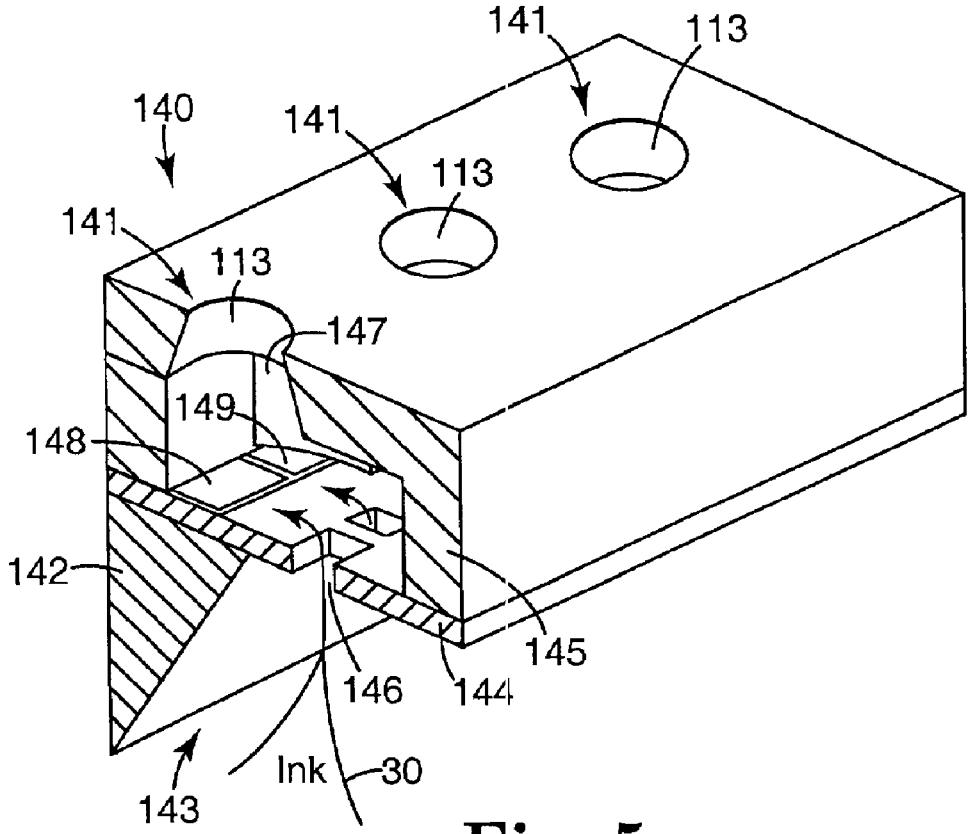
FIG. 5 is a cross-sectional perspective view of one embodiment of a printhead die.

A portion of one embodiment of a printhead die 140 is illustrated in a cross-sectional perspective view in FIG. 5. Printhead die 140 includes an array of drop ejection elements or drop generators 141. Drop generators 141 are formed on a substrate 142 which has an ink feed slot 143 formed therein. Ink feed slot 143 provides a supply of ink to drop generators 141. Printhead die 140 includes a thin-film structure 144 on top of substrate 142. Printhead die 140 includes an orifice layer 145 on top of thin-film structure 144.

Each drop generator 141 includes a nozzle 113, a vaporization chamber 147, and a firing resistor 148. Thin-film structure 144 has an ink feed channel 146 formed therein which communicates with ink feed slot 143 formed in substrate 142. Orifice layer 145 has nozzles 113 formed therein. Orifice layer 145 also has vaporization chamber 147 formed therein which communicates with nozzles 113 and ink feed channel 146 formed in thin-film structure 144. Firing resistor 148 is positioned within vaporization chamber 147. Leads 149 electrically couple firing resistor 148 to circuitry controlling the application of electrical current through selected firing resistors.

During printing, ink 30 flows from ink feed slot 143 to nozzle chamber 147 via ink feed channel 146. Each nozzle 113 is operatively associated with a corresponding firing resistor 148, such that droplets of ink within vaporization chamber 147 are ejected through the selected nozzle 113 (e.g., normal to the plane of the corresponding firing resistor 148) and toward a print medium upon energization of the selected firing resistor 148.

An example printhead 140 typically includes a large number of drop generators 141 (e.g., 1000 or more drop generators). In order to enable an inkjet printhead having very high drop rate generation, one example embodiment of printhead 140 has very high nozzle packing density. For example, one example embodiment of printhead 140 is approximately ½ inch long and contains four offset columns of nozzles, each column containing 304 nozzles for a total of 1,216 nozzles per printhead 140. In another example embodiment, each printhead 140 is approximately one inch long and contains four offset columns of nozzles 113, each column containing 528 nozzles for a total of 2,112 nozzles per printhead. In both of these example embodiments, the nozzles 113 in each column have a pitch of 600 dots per inch (dpi), and the columns are staggered to provide a printing resolution, using all four columns, of 2400 dpi. These embodiments of printhead 140 can print at a single pass resolution of 2400 dpi along the direction of the nozzle columns or print at a greater resolution in multiple passes. Greater resolutions may also be printed along the scan direction of the printhead 140.

Thin-film structure 144 is also herein referred to as a thin-film membrane 144. In one example embodiment, containing four offset columns of nozzles, two columns are formed on one thin-film membrane 144 and two columns are formed on another thin-film membrane 144.

Figure 6:
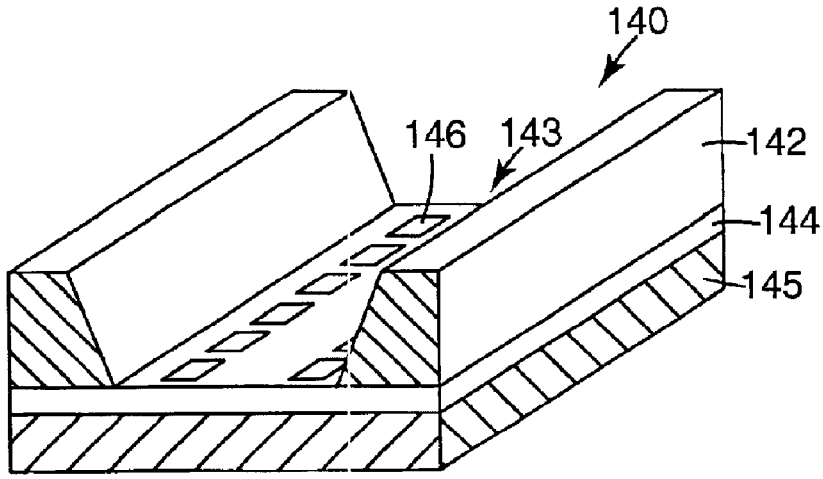
FIG. 6 is a cross-sectional perspective underside view of one embodiment of the printhead die of FIG. 5.

A perspective underside view of printhead 140 is illustrated generally in FIG. 6. As illustrated in FIG. 6, a single ink feed slot 143 provides access to two columns of ink feed channels 146. In one embodiment, the size of each ink feed channel 146 is smaller than the size of a nozzle 113 so that particles in ink 30 are filtered by ink feed channels 146 and do not clog nozzles 113. The clogging of an ink feed channel 146 has little effect on the refill speed of a vaporization chamber 147, because multiple ink feed channels 146 supply ink 30 to each vaporization chamber 147. Accordingly, in one embodiment, there are more ink feed channels 146 than ink vaporization chambers 147.

Figure 7:
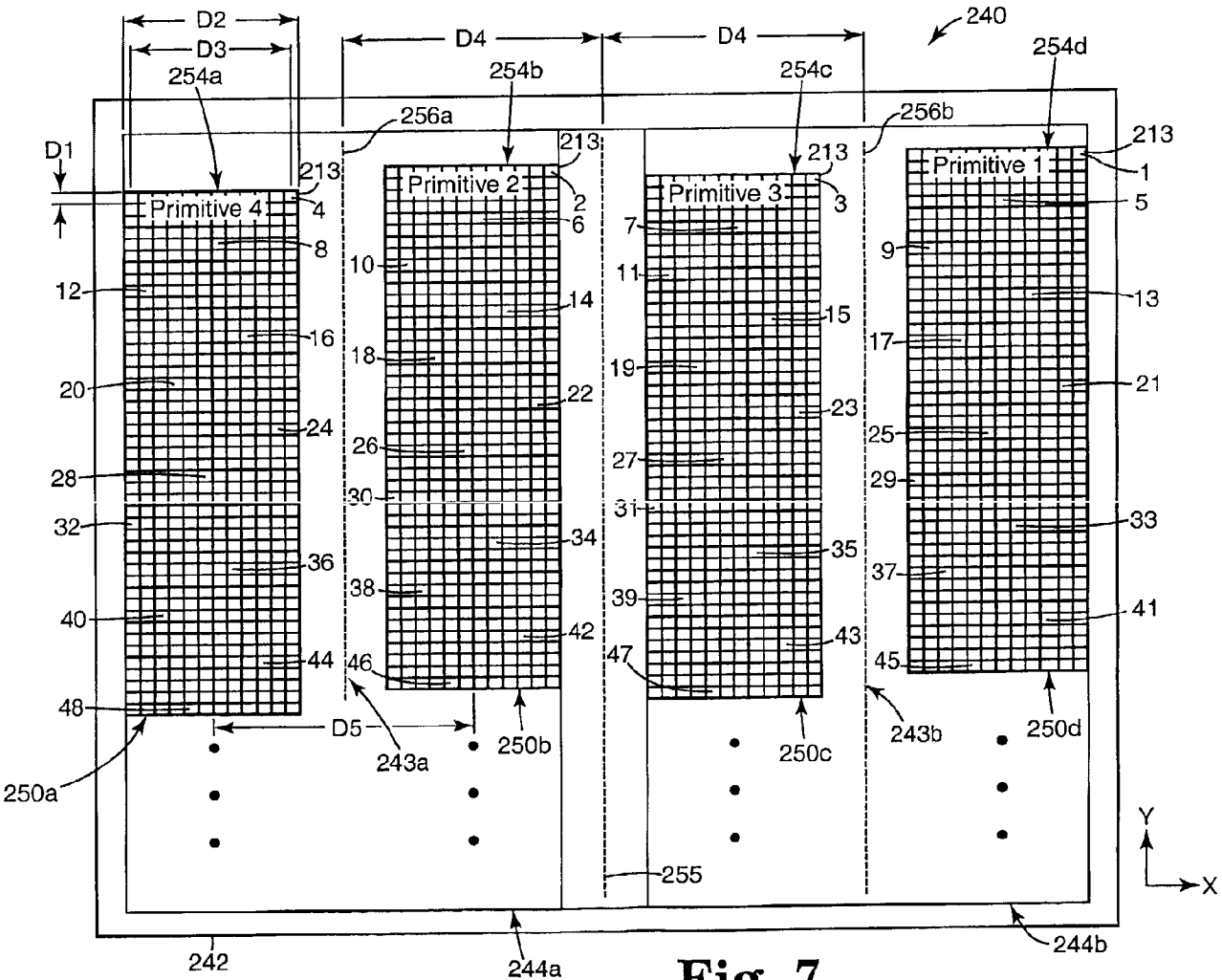
FIG. 7 is a diagramic view of a printhead die nozzle and primitive layout for a printhead with a very high nozzle packing density.

A portion of one embodiment of a printhead die 240 is illustrated in diagram form in FIG. 7. Printhead die 240 includes two thin-film membranes 244*a* and 244*b* formed on a single printhead die substrate 242. Nozzle columns 254*a* and 254*b* are formed on thin-film membrane 244*a*. Nozzle columns 254*c* and 254*d* are formed on thin-film membrane 244*b*. Nozzle columns 254*a*–254*d* are offset to produce very high nozzle densities, such as 2400 nozzles per inch (npi).

Each nozzle column 254 includes N/4 number of primitives 250, but FIG. 7 illustrates only one primitive 250 for each column 254 (e.g., nozzle column 254*a* includes primitive 250*a*, nozzle column 254*b* includes primitive 250*b*, nozzle column 254*c* includes primitive 250*c*, and nozzle column 254*d* includes primitive 250*d*). Since there are N/4 primitives 250 in each nozzle column 254, there are N primitives in printhead die 240. In one example embodiment, N is equal to 176 resulting in 44 primitives per nozzle column 254, 88 primitives on each thin-film membrane 244, and 176 primitives on printhead die 240.

The nozzle address has M address values. Each primitive 250 includes M' nozzles 213, wherein M' is at most M and M' can possibly vary from primitive to primitive. In the illustrated embodiment, each primitive 250 includes 12 nozzles. Thus, 12 nozzle address values are required to address all 12 nozzles within a primitive 250. The nozzle address is cycled through all M nozzle address values to control the nozzle firing order so that all nozzles can be fired, but only a single nozzle in a primitive 250 is fired at a given time.

The example nozzle layout of example printhead die 240 has a total primitive to address ratio of N/M=176/12= approximately 14.7. In addition, each nozzle column 254 contains 44×12 nozzles=528 nozzles resulting in 4×528=2, 112 total nozzles in printhead die 240. In another example embodiment, such as disclosed in the above-incorporated patent application entitled "PRINTHEAD WITH HIGH NOZZLE PACKING DENSITY," each nozzle column contains 38 primitives for a total of 152 primitives, and each primitive contains eight nozzles for a total of 304 nozzles in each nozzle column and a total of 1,216 nozzles per printhead. In this second example embodiment, eight addresses are required to address all nozzles resulting in a primitive to address ratio N/M=152/8=19 for the printhead die. The very high nozzle packing density achieved with these example printhead nozzle layouts enables these high primitive to address ratios to enable very high drop rate generation.

In FIG. 7, the printhead die 240 nozzle layout is not illustrated to scale, but rather, is illustrative of how the four nozzle columns 254 are staggered relative to each other and how a skip pattern operates. Other embodiments of printhead 240 have other suitable numbers of staggered nozzle columns 254 (e.g., 2, 6, 8, etc.). Each nozzle column 254 has a width dimension, indicated by distance arrows D2, along a horizontal or X-axis, which is 1/1200 inch in an example embodiment. The 12 nozzles in each primitive are staggered along the X-axis. The total amount of stagger within a primitive 250 is represented by distance arrows D3, which in the example embodiment is approximately 19.4 microns or micrometers ($\mu$m). The total stagger within a primitive 250 represented by arrows D3 is measured from the innermost firing resistor to the outermost firing resistor and is also referred to as the total scan axis stagger. For example, in primitive 250*a* the total scan axis stagger is measured from firing resistor 4 to firing resistor 32 along the X-axis. Along the scan axis, the horizontal resolution is determined by carriage speed and firing frequency, not physical nozzle location (e.g., 2400 dpi along the scan axis could be achieved with a 20 inch per second (ips) carriage speed and a firing frequency of 48 Khz.) The example 1/1200 inch distance D2 represents an optimization for 1200 dpi printing.

Each diagramic cell representing placement of nozzles in FIG. 7 has a distance, represented by arrows D1, along a vertical (Y) axis, which is 1/2400 inch in an example embodiment. Each diagramic cell is not illustrated to scale along the horizontal (X) axis. The nozzles of nozzle column 254*a* are offset along the Y-axis by 1/1200 inch relative to the nozzles of nozzle column 254*b* on thin-film membrane 244*a*. Similarly, the nozzles of nozzle column 254*c* are offset by 1/1200 inch along the Y-axis relative to the nozzles of nozzle column 254*d* on thin-film membrane 244*b*. In addition, the nozzles of nozzle columns 254*a* and 254*b* are offset along the Y-axis by 1/2400 inch from the nozzles of nozzle columns 254*c* and 254*d*. As a result, the primitive stagger pattern in the vertical direction along the Y-axis creates a nozzle spacing of all nozzles in the four nozzle columns 254*a*–254*d* of 2400 npi.

The two thin-film membranes 244*a* and 244*b* are disposed about a center axis, indicated at 255, of substrate 242 of printhead 240. Ink is fed to the drop generators through trenches formed in substrate 242 referred to as left ink feed slot 243*a* and right ink feed slot 243*b*. The physical structure of such an ink slot is indicated at 143 in FIGS. 5 and 6 and described above. The drop generators of nozzle column 254*a* and 254*b* are fed ink by left ink feed slot 243*a* having a center along line 256*a*. The drop generators of nozzle columns 254*c* and 254*d* are fed ink from right ink feed slot 243*b* having a center along line 256*b*. A distance, represented by arrows D4, is indicated from the center of substrate 242 to the center of each ink feed slot 243 (i.e., between center line 255 and 256*a* and between center line 255 and center line 256*b*). In the example embodiment of printhead 240, distance D4 is approximately 899.6 $\mu$m. A column spacing distance on each thin-filmed membrane 244 is indicated by arrows D5 and represents the horizontal distance along the X-axis from the center of the primitive 250 on the left of an ink feed slot 243 to the center of the primitive 250 on the right of the ink feed slot 243. In one example embodiment, the column spacing distance D5 is approximately 169.3 $\mu$m.

All of the above distances D1–D5 are implementation dependent and very based on specific parameters and design choices, and the above example values represent suitable values for one exemplary implementation of printhead die 240.

In the embodiment of printhead die 240 illustrated in FIG. 7, primitive 250*d* is referred to as primitive 1 and includes resistors 1, 5, 9, 13, 17, 21, 25, 29, 33, 37, 41, and 45. Primitive 250*b* is referred to as primitive 2 and includes resistors 2, 6, 10, 14, 18, 22, 26, 30, 34, 38, 42, and 46. Primitive 250*c* is referred to as primitive 3 and includes resistors 3, 7, 11, 15, 19, 23, 27, 31, 35, 39, 43, and 47. Primitive 250*a* is referred to as primitive 4 and includes resistors 4, 8, 12, 16, 20, 24, 28, 32, 36, 40, 44, and 48. This example resistor numbering and primitive numbering is herein referred to as a standard orientation representing printhead die 240 with the nozzles 213 facing the viewer with resistor 1 at the top of printhead die 240. Thus, in this standard orientation, as to the primitives 250 adjacent to right ink feed slot 243*b*, the top right primitive is primitive 1, the top left primitive is primitive 3, the bottom right primitive is 173, and the bottom left primitive is primitive 175. As to the primitives 250 adjacent to left ink feed slot 243*a*, the top right primitive is primitive 2, the top left primitive is primitive 4, the bottom right primitive is primitive 174, and the bottom left primitive is primitive 176.

The firing resistor numbering is such that the top firing resistor for the firing resistors adjacent to right ink feed slot 243*b* is resistor 1, while the bottom firing resistor adjacent to right ink feed slot 243*b* is resistor 2111. As to the firing resistors adjacent to left ink feed slot 243*a*, the top firing resistor is resistor 2, while the bottom firing resistor is resistor 2112. The firing resistors are disposed on each edge of an ink feed slot 243 at a vertical spacing of 1/600 inch along the Y-axis. As discussed above, the firing resistors on the left side of each ink feed slot 243 are offset from the firing resistors on the right side of the same ink feed slot 243 by 1/1200 inch. All of the firing resistors adjacent to the left ink feed slot 243*a* are offset by 1/2400 inch with respect to the firing resistors adjacent to the right ink feed slot 243*b*. In an example printing operation by printhead 240, the position of ink dots in a vertical line printed from top to bottom corresponds to the number of the firing resistor which fired the ink dot from dot 1 at the top to dot 2112 at the bottom of the vertical line.

Cross-talk refers to undesirable fluidic interactions between neighboring nozzles. Certain aspects of the very high density nozzle layout illustrated in FIG. 7 increase cross-talk. First, nozzles 213 within a nozzle column 254 are disposed at a high density pitch, such as a 600 npi pitch, which places the nozzles 213 in closer proximity then in previous nozzle layout designs. In addition, the example printhead 240 is designed to operate at very high drop rate generation frequencies, such as up to 48 Khz in the embodiment having 2112 total nozzles in the printhead and up to 72 Khz in the embodiment having 1,216 total nozzles in the printhead. In these exemplary very high nozzle packing densities with a corresponding very high firing frequency, ink flux rate and ink refill rates are correspondingly very high. The ink feed slot 143/243 design illustrated in FIGS. 5, 6, and 7 provides high ink refill rates to the drop generators.

Conventional inkjet printheads only need to consider cross-talk between neighboring nozzles which are located in adjacent positions within a nozzle column, because nozzle columns are typically separated by sufficient distance such that nozzles in different nozzle columns do not interact fluidically. In the very high nozzle packing density of inkjet printhead 240, cross-talk potentially exists between neighboring nozzles, both within nozzle columns 254 as well as the nozzle column located on the opposite side of the adjacent ink feed slot 243 on the thin-film membrane 244. For example, nozzles 213 within nozzle columns 254*a* and 254*b* are considered neighboring nozzles from a cross-talk point of view, because these nozzles are both fed ink from left ink feed slot 243*a*. In addition, the nozzles 213 in nozzle columns 254*c* and 254*d* are considered neighboring nozzles from a cross-talk point of view, because these nozzles are both fed ink from right ink feed slot 243*b*.

A detailed discussion of certain cross-talk avoidance features which can be implemented in an example printhead 240 are discussed in detail in the above-incorporated Patent Application entitled "PRINTHEAD WITH HIGH NOZZLE PACKING DENSITY." One of the cross-talk avoidance features is the use of skip patterns in the address sequence order controlling the nozzle firing order of the inkjet printhead 240 so that adjacent nozzles are not fired consecutively to maximize the temporal separation of nozzle firings. In addition to this temporal improvement, fluidic isolation can be achieved by forming peninsulas extending between adjacent nozzles to further reduce cross-talk. Any suitable cross-talk reduction feature implemented in printhead 240 preferably does not substantially reduce lateral flow to the drop generators. Even though there is substantial ink flow along the length of the ink feed slots 243, printheads 240 having very high nozzle packing densities, such as 600 npi or greater, and operating at high frequencies, such as 18 Khz and higher, need to maintain sufficient lateral ink flow to produce the required very high refill rates.

One example suitable skip firing pattern is SKIP 4 where every fifth nozzle in a primitive is fired in sequence. For example, a sequence of SKIP 4 would produce a nozzle firing sequence in primitive 250*d* which fires every fifth nozzle to yield 1-21-41-13-33-5-25-45-17-37-9-29-1-21-etc.

The nozzle address is cycled through all M nozzle address values to control the nozzle firing order so that all nozzles can be fired, but only a single nozzle in a primitive is fired at a given time.

One example type of printhead includes an address generator and a hard-coded address decoder at each nozzle for controlling nozzle firing order. In this type of printhead, the nozzle firing sequence can only be modified by changing appropriate metal layers on the printhead die. Thus, if a new nozzle firing order is desired in this type of printhead, the set nozzle firing sequence is modified by changing one or more masks to thereby change the metal layers that determine the nozzle firing sequence.

In one embodiment, the nozzle firing order control by the nozzle address is programmable via printhead electronics having a programmable nozzle firing order controller which can be programmed to change the nozzle firing order in the printhead so that new masks do not need to be generated if a new firing order is desired. Such an inkjet printhead with a programmable nozzle firing order controller is described in detail in the above-incorporated patent application entitled "PROGRAMMABLE NOZZLE FIRING ORDER FOR INKJET PRINTHEAD ASSEMBLY."

The above-described very high nozzle packing densities and the below-described printhead electronics enable a high-drop generator count printhead with at least 1000 drop generators and a primitive to address ratio of at least 10 to 1. A primitive to address ratio of at least 10 to 1 enables operating frequencies of at least 20 Khz with the ability to generate at least 20 million drops of ink per second.

In the exemplary embodiment of printhead 240 illustrated in FIG. 7, printhead 240 includes 2112 drop generators and can operate up to 48 Khz. In another example embodiment, printhead 240 includes 1216 drop generators and can operate up to a frequency of 72 Khz. In the 2112 drop generator embodiment, operating at up to approximately 48 Khz, there are 176 primitives and 12 address values yielding a primitive to address ratio of approximately 14.7 for a total of 188 combined count of primitives and addresses. In the 1216 drop generator embodiment, operating up to approximately 72 Khz, there are 152 primitives and eight address values yielding a primitive to address ratio of approximately 19 to 1 for a total of 160 combined count of primitives and addresses.

A suitable printhead 240 includes de-multiplexing electronics, such as described in the Background of the Invention section of the present specification and in the above-incorporated Patent Application entitled "A HIGH PERFORMANCE PRINTING SYSTEM AND PROTOCOL," to permit serial data to be received by printhead 240 from ten or less data lines. In one suitable embodiment, multiplexing electronics in printhead 240 reduces the required number of nozzle data inputs to four nozzle data lines.

In one embodiment, printhead 240 includes firing resistors 48 which are implemented in high ohm resistors to reduce operating currents. A suitable high ohm firing resistor 48 comprises tungsten silicon nitride (WSiN). A suitable resistance range for firing resistors 48 is from approximately 800 ohms to approximately 1000 ohms. The reduced operating currents resulting from the high ohm firing resistors 48 lowers currents resulting in lower losses across parasitic resistances.

In one embodiment, in addition to the high ohm firing resistors 48 printhead 240 employs high printhead operating voltages. In one example embodiment of printhead 240, processing techniques allow printhead operating voltages of approximately 35 volts. With the high printhead operating voltages, printhead 240 is operated with lower currents.

Several components and systems within printhead 240 have minimum operating as well maximum operating temperatures and voltages. Maximum operating temperatures are established to ensure printhead reliability and avoid print quality defects. Similarly, maximum operating voltages are established to maximize printhead life.

One type of energy level determination is the determination of an optimal operating voltage of printhead assembly 12. In one embodiment, the optimal operating voltage is determined at the time of manufacturer and is encoded in a memory device in printhead assembly 12. However, after printhead assembly 12 is installed in printing system 10, a somewhat higher power supply voltage is required in order to deliver the proper operating voltage to the printhead assembly, because connection to the printing system introduces additional parasitic resistances. The operating voltage must be sufficiently high to supply the proper voltage to printhead assembly 12, but below the maximum power supply voltage.

In one embodiment, an optimal operating voltage is determined by first ascertaining the turn-on energy (TOE) of printhead assembly 12. The TOE is herein defined to be the amount of energy that is sufficient to cause drop ejection from nozzles 13 of printhead assembly 12. In one embodiment, at the time of the manufacturer of printhead assembly 12, the TOE is ascertained by applying a high amount of energy and observing a drop ejection. The TOE is then gradually reduced until drop ejection ceases. In this embodiment, the TOE is established as the energy point just above the point where drop ejection ceases. An over-energy margin is added to the TOE to obtain a suitable operating voltage which is written into the memory device within printhead assembly 12.

In one embodiment, the optimal operating voltage is adjusted so as to achieve an energy level approximately 20 percent over the TOE. The following Equation I represents a calculation for energy.

$$\text{Energy}=\text{Power}*\text{Time} \qquad \text{Equation I}$$

wherein Time is measured as the pulse width of the fire pulse; and

Power is given by the following Equation II.

$$\text{Power}=V^2/r \qquad \text{Equation II}$$

wherein r is equal to the resistance of the printhead assembly 12; and

V is equal to the suitable operating voltage.

Thus, by using Equations I and II, and setting the energy value in Equation I to 20 percent greater than the TOE, the optimal operating voltage is obtained.

As address count decreases, and the number of primitives in a printhead does not decrease, the primitive to address ratio increases, which permits the firing frequencies to be increased. However, the address count decreasing results in an increased operating energy range associated with high peak currents and high losses across parasitic resistances. Therefore, high ohm firing resistors 48, such as approximately 800 to 1000 ohm resistors, and high printhead operating voltage, such as approximately 35 volts, reduce peak currents and reduce losses across parasitic resistances enabling decreased address counts and thereby very high drop rate generation.

The following Table I represents calculated maximum firing pulse widths in microseconds ($\mu$s) for nozzle addresses varying from 11 to 16 and for nozzle firing frequencies of 9 Khz, 18 Khz, 24 Khz, 36 Khz, and 48 Khz for an example printhead 240. Table I assumes a dead time between fire pulses of approximately 0.156 $\mu$s, and a carriage jitter margin equal to approximately ten percent. Carriage jitter is herein referred to as a timing error of fire pulses associated with carriage vibration. With the carriage jitter margin of approximately ten percent, all nozzles in a primitive 250 of printhead 240 are fired in approximately 90 percent of a firing cycle to thereby leave approximately a ten percent carriage jitter margin.

TABLE I

| Addresses | 9 Khz | 18 Khz | 24 Khz | 36 Khz | 48 Khz |
|---|---|---|---|---|---|
| 11 | 8.93 | 4.39 | 3.25 | 2.12 | 1.55 |
| 12 | 8.18 | 4.01 | 2.97 | 1.93 | 1.41 |
| 13 | 7.54 | 3.69 | 2.73 | 1.77 | 1.29 |
| 14 | 6.99 | 3.42 | 2.52 | 1.63 | 1.18 |
| 15 | 6.51 | 3.18 | 2.34 | 1.51 | 1.09 |
| 16 | 6.09 | 2.97 | 2.19 | 1.41 | 1.02 |

The following Table II represents suitable calculated energy in microjoules ($\mu$j) available at the firing resistor for a range from 32 volts to 35 volts at the firing resistor. Table II assumes a firing resistor value of 900 ohms, and fire pulse widths from Table I above. The calculated energy values in Table II are for addresses ranging from 11 to 16 and for firing frequencies of 9 Khz, 18 Khz, 24 Khz, 36 Khz, and 48 Khz.

TABLE II

| Addresses | 9 Khz | 18 Khz | 24 Khz | 36 Khz | 48 Khz |
|---|---|---|---|---|---|
| 11 | 9.83–11.74 | 4.82–5.77 | 3.57–4.27 | 2.33–2.78 | 1.70–2.03 |
| 12 | 8.98–10.75 | 4.41–5.27 | 3.26–3.90 | 2.12–2.53 | 1.55–1.85 |
| 13 | 8.28–9.90 | 4.05–4.85 | 3.00–3.59 | 1.94–2.32 | 1.41–1.69 |
| 14 | 7.68–9.18 | 3.75–4.49 | 2.77–3.31 | 1.79–2.14 | 1.30–1.55 |
| 15 | 7.151–8.56 | 3.49–4.18 | 2.58–3.08 | 1.66–1.99 | 1.20–1.44 |
| 16 | 6.70–8.01 | 3.26–3.90 | 2.40–2.87 | 1.55–1.85 | 1.12–1.33 |

The ability to eject multiple individual ink drops at a high frequency is determined by certain factors, such as: (1) minimum time to sequence through address lines; (2) ejection chamber refill time; (3) drop stability; and (4) maximum data transmission rates between printing system 10 and printhead assembly 12. Consequently, designing printhead 240 with a small number of address lines enables high speed ink ejection by reducing the time it takes to complete the sequence through address lines. Since there are fewer nozzles 213 within each primitive 250 than on conventional printhead designs, the ejection frequency of a single nozzle 213 can be much higher.

There are two frequencies associated with multi-drop printing. They are defined as a base frequency (F) and a burst frequency (f). The base frequency is established by the scanning carriage speed in inches per second (ips) multiplied by the resolution or pixel size in dots per inch (dpi). The base period for a pixel is equal to 1/F. The following Example I provides a corresponding base frequency and base period for an example carriage speed of 40 ips and example 1200 dpi resolution.

EXAMPLE I

Base Frequency=$F$=(40 ips)×1200 dpi=48,000 dots/sec=48 Khz

Base Period=1/$F$=1/48,000=20.8 Ms

The burst frequency (f) is always equal to or greater than the base frequency (F). The burst frequency is related to the maximum number of drops to be deposited on any single pixel in a single pass of the scanning carriage. The maximum number of drops that can be deposited on a pixel in one pass is equal to the number of address lines. Thus, the burst frequency is equal to the base frequency multiplied by the maximum number of drops to be placed in a given pixel in a single pass. In an example printing operation, a burst frequency of 48 Khz can be achieved for selected nozzles with the base frequency reduced to approximately 12 Khz, if four drops are to be placed in a pixel, or with the base frequency reduced to approximately 6 Khz, if eight drops are to be placed in a pixel. The burst frequency can thereby achieve higher virtual resolutions which are multiples of the actual base resolution (e.g, four drops per pixel per single pass for 600 dpi base resolution yields 2400 dpi virtual resolution.) The burst frequency can be employed to compensate for defective nozzles by firing selected nozzles more than one time in a given pixel in a single pass.

The approximate maximum burst frequency (f) is given by the following Equation III.

Maximum Burst Frequencies(f)≈1/(Number of Addresses)(Fire Pulse Width+Dead Time) Equation III According to the above Equation III, as the number of address lines decrease and fire pulse width decreases, the maximum burst frequency increases. For example, the maximum burst frequency is 53 Khz if there are 12 address lines, a maximum fire pulse width of 1.4 $\mu$s, and a dead time between fire pulses of 0.156 $\mu$s. Nevertheless, ink fluidic issues, such as ink puddling, ink drop directionality, and ink drop volume variation, also limit the maximum practical firing frequency.

Typically, a high-current load on the power supply (e.g., power supply 22) supplying the electrical current to firing resistors 48 occurs if a large number of firing resistors are simultaneously energized on a single printhead die, such as an example printhead die 240 having 176 primitives resulting in possibly 176 firing resistors 48 being simultaneously energized on a single printhead die 240. The resulting high electrical current flowing through parasitic resistances in conductors to the printhead die causes the voltage at the printhead die to sag. Less energy is delivered to the firing resistors as a result of this voltage sag at the printhead die.

In one conventional inkjet printing system, large by-pass capacitors are disposed adjacent to the printhead to alleviate a portion of this voltage sag. Nevertheless, any resistance between the large by-pass capacitors and the printhead is not compensated for in this conventional inkjet printing system. Furthermore, a DC sag on the power supply supplying the electrical current to the firing resistors under continuous load is also not compensated for in this conventional inkjet printing system.

In one conventional inkjet printing system, the duration of the power being supplied to the firing resistors is modulated in response to a change in the power supply voltage at the printhead. In this conventional inkjet printing system, constant energy is delivered to each firing resistor. Nevertheless, firing resistors receive more instantaneous power when only a few firing resistors are energized. The life of a firing resistor can be increased by reducing the amount of instantaneous power delivered to the firing resistor. Therefore, there is a desire to have both a fixed power applied to the firing resistors and a fixed duration that the fixed power is applied to the firing resistors.

Figure 8:
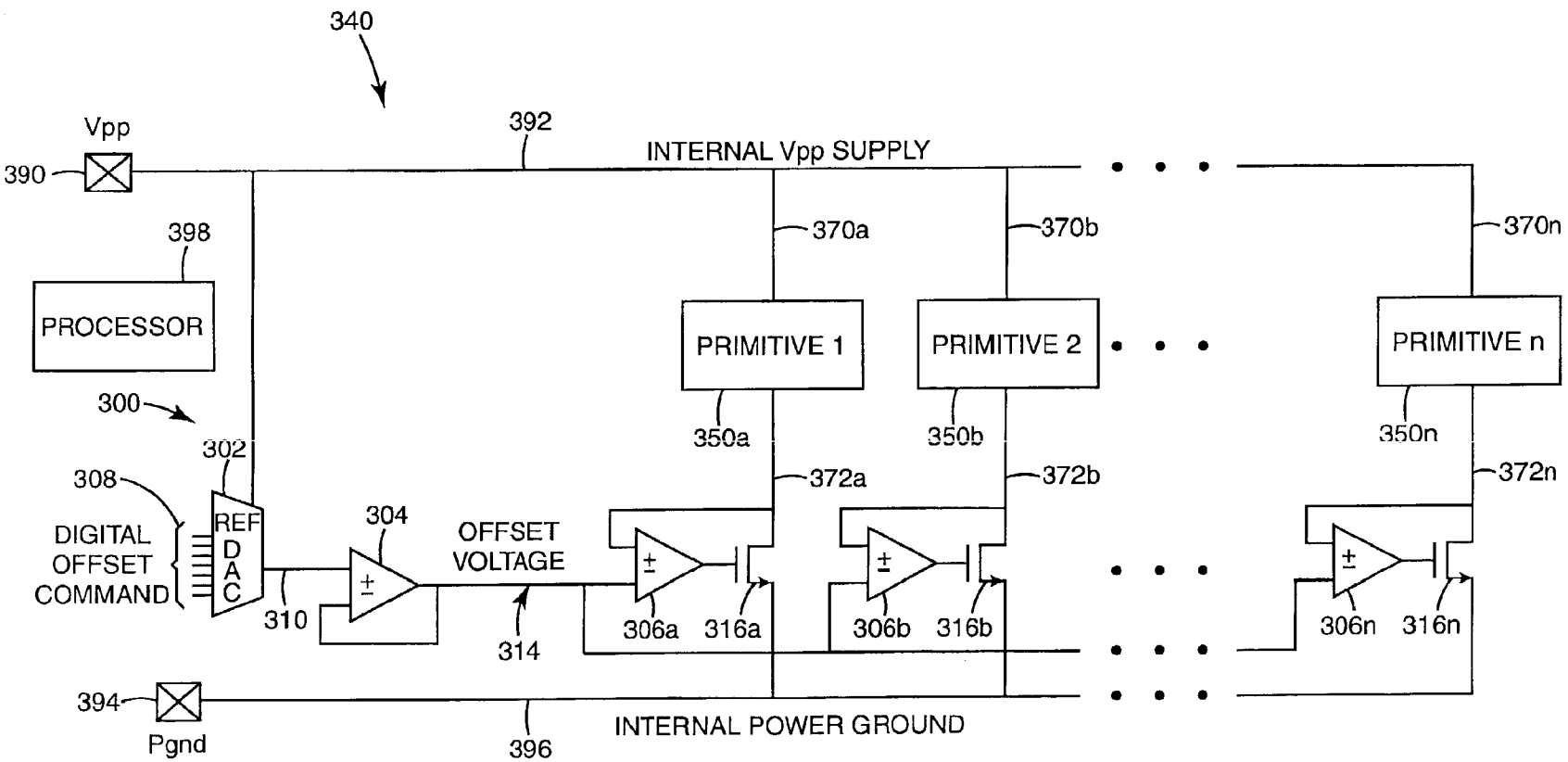
FIG. 8 is a block and schematic diagram illustrating portions of one embodiment of an inkjet printhead having integrated control of power delivery to firing resistors.

One embodiment of a printhead 340 having a linear power regulator 300 is illustrated generally in block and schematic diagram form in FIG. 8. Printhead 340 employs linear power regulator 300 to compensate for off-printhead die parasitic resistances which cause the power supply voltage (Vpp) to sag at the input to printhead 340 to thereby enable a higher primitive to address ratio and higher ink drop rate frequency. Printhead 340 receives Vpp power from power supply 22 at Vpp input pin(s) 390 and receives a corresponding power ground at input pin(s) 394. An internal Vpp power supply path 392 is coupled to Vpp power pins 390 to internally supply Vpp power to the firing resistors 48 in printhead 340. An internal power ground 396 is coupled to power ground pins 394 to internally supply the corresponding power ground to the firing resistors 48 in printhead 340.

Each of the primitives 350*a*–350*n* includes a corresponding one of the primitive power lines 370*a*–370*n* which is directly coupled to the internal Vpp power supply path 392. Each of the primitives 350*a*–350*n* includes a corresponding one of the primitive ground lines 372*a*–372*n* which is not directly coupled to the internal power ground 396. Rather, primitive ground lines 372*a*–372*n* are controlled with linear power regulator 300.

Linear power regulator 300 includes a current-mode digital-to-analog converter (DAC) 302, a buffer amplifier 304, and a series of feedback amplifiers 306*a*, 306*b*, . . . , 306*n*. Each of the feedback amplifiers 306*a*–306*n* corresponds to a corresponding one of the primitives 350*a*–350*n*, where each primitive 350 can only have one firing resistor 48 energized at a given time.

DAC 302 receives a digital offset command on lines 308. The internal Vpp power supply path 392 is coupled to DAC 302 and provides a reference voltage for DAC 302. DAC 302 is programmed by the digital offset command on lines 308 to produce an analog offset voltage from the internal Vpp power supply path 392 voltage to thereby track any movement of the Vpp power supply at the Vpp input pins 390 of printhead 340. The digital offset command on lines 308 represents the amount of offset voltage necessary to compensate for off-printhead die parasitic resistances that cause the Vpp power supply voltage to sag at the input to printhead 340.

In one embodiment, printhead 340 includes a processor 398 which provides the digital offset command on lines 308. In another embodiment, the digital offset command is provided by electronic controller 20 to printhead 340. In yet another embodiment, the digital offset command on lines 308 is provided by a processor external to the printhead(s) 340 but contained within printhead assembly 12. In any of these embodiments, the digital offset command is typically stored in a register which is read and written by a processor, such as processor 398, via an internal bus of printhead 340.

DAC 302 coverts the digital offset command on lines 308 to the analog offset voltage from the internal Vpp power supply path voltage and provides the analog offset voltage on line 310. The analog offset voltage provided on line 310 is coupled to the positive input of buffer amplifier 304. Buffer amplifier 304 has a unity gain and provides a buffered offset voltage on a line 314 having a low-impedance output characteristic so that the offset voltage on line 314 can be distributed across the printhead die 340. The offset voltage on line 314 is fed back to the negative input of buffer amplifier 304.

The offset voltage on line 314 is provided to the negative input terminal of each feedback amplifier 306*a*–306*n*. The positive input of each feedback amplifier 306*a*–306*n* is respectively coupled to a corresponding one of the primitive ground lines 372*a*–372*n*. The output of each feedback amplifier 306*a*–306*n* is respectively coupled to the gate of a corresponding FET 316*a*, 316*b*, . . . , 316*n*.

The source of each FET 316*a*–316*n* is coupled to internal power ground 396. The drain of each FET 316*a*–316*n* is respectively coupled to a corresponding one of the primitive ground lines 372*a*–372*n*. The feedback configuration between each FET 316 and feedback amplifier 306 forces the buffered offset voltage on line 314 to the respective primitive ground line 372.

Only one resistor 48 inside of each primitive 350 can be energized at a given time. An energized firing resistor 48 in a given primitive 350 has the offset voltage coupled to its low-side instead of the internal power ground 396 and the internal Vpp power supply path 392 coupled to its high-side. Since the high-side of the energized firing resistor 48 is coupled to the internal Vpp power supply path 392, the energized firing resistor 48 has a constant voltage across it equal to a difference of the Vpp voltage and the programmed offset voltage even if the Vpp voltage sags. This tracking of Vpp voltage movement results in a substantially constant power being delivered to the energized firing resistors 48 in printhead 40.

Figure 9:
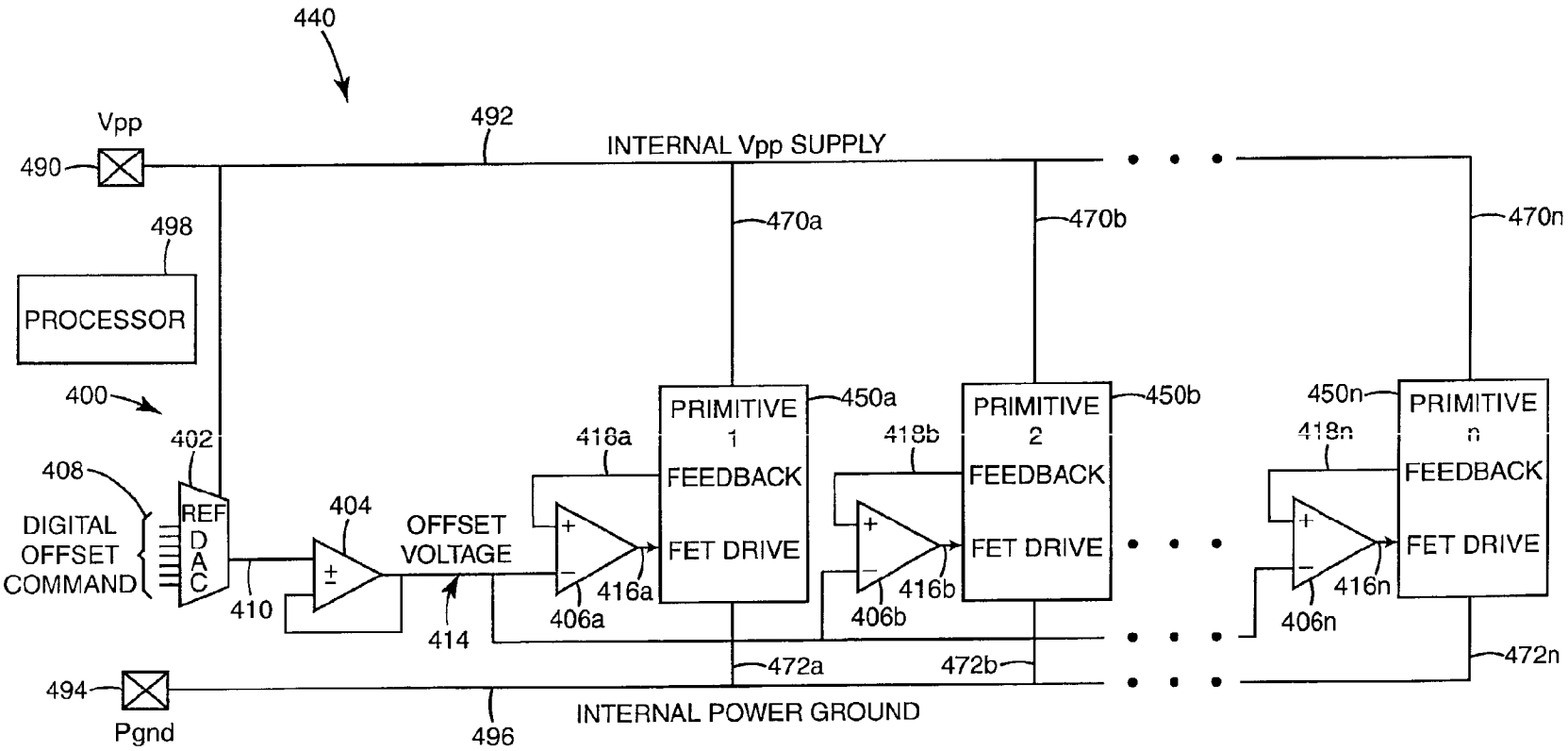
FIG. 9 is a block and schematic diagram illustrating portions of another embodiment of an inkjet printhead having integrated control of power delivery to firing resistors.

An alternative embodiment of a printhead 440 having a linear power regulator 400 is illustrated generally in block and schematic diagram form in FIG. 9. Printhead 440 employs linear power regulator 400 to compensate for off-printhead die parasitic resistances which cause the power supply voltage (Vpp) to sag at the input to printhead 440 to thereby enable a higher primitive to address ratio and higher ink drop rate frequency. Printhead 440 receives Vpp power from power supply 22 at Vpp input pin(s) 490 and receives a corresponding power ground at input pin(s) 494. An internal Vpp power supply path 492 is coupled to Vpp power pins 490 to internally supply Vpp power to the firing resistors 448 (shown in FIG. 10) in printhead 440. An internal power ground 496 is coupled to power ground pins 494 to internally supply the corresponding power ground to the firing resistors 448 in printhead 440.

Each of N primitives 450*a*, 450*b*, . . . , 450*n* includes a corresponding one of primitive power lines 470*a*, 470*b*, . . . , 470*n* which is directly coupled to the internal Vpp power supply path 492. Each of the primitives 450*a*–450*n* includes a corresponding one of primitive ground lines 472*a*, 472*b*, . . . , 472*n* which is directly coupled to the internal power ground 496.

Linear power regulator 400 includes a current-mode digital-to-analog converter (DAC) 402, a buffer amplifier 404, and a series of feedback amplifiers 406*a*, 406*b*, . . . , 406*n*. Each of the feedback amplifiers 406*a*–406*n* corresponds to a corresponding one of the primitives 450*a*–450*n*, where each primitive 450 can only have one firing resistor 448 energized at a given time.

DAC 402 receives a digital offset command on lines 408. The internal Vpp power supply path 492 is coupled to DAC 402 and provides a reference voltage for DAC 402. DAC 402 is programmed by the digital offset command on lines 408 to produce an analog offset voltage from the internal Vpp power supply path 492 voltage to thereby track any movement of the Vpp power supply at the Vpp input pins 490 of printhead 440. The digital offset command on lines 408 represents the amount of offset voltage necessary to compensate for off-printhead die parasitic resistances that cause the Vpp power supply voltage to sag at the input to printhead 440.

In one embodiment, printhead 440 includes a processor 498 which provides the digital offset command on lines 408. In another embodiment, the digital offset command is provided by electronic controller 20 to printhead 440. In yet another embodiment, the digital offset command on lines 408 is provided by a processor external to the printhead(s) 440 but contained within printhead assembly 12. In any of these embodiments, the digital offset command is typically stored in a register which is read and written by a processor, such as processor 498, via an internal bus of printhead 440.

DAC 402 coverts the digital offset command on lines 408 to the analog offset voltage from the internal Vpp power supply path voltage and provides the analog offset voltage on line 410. The analog offset voltage provided on line 410 is coupled to the positive input of buffer amplifier 404. Buffer amplifier 404 has a unity gain and provides a buffered offset voltage on a line 414 having a low-impedance output characteristic so that the offset voltage on line 414 can be distributed across the printhead die 440. The offset voltage on line 414 is fed back to the negative input of buffer amplifier 404.

The offset voltage on line 414 is provided to the negative input terminal of each feedback amplifier 406*a*–406*n*. The positive input of each feedback amplifier 406*a*–406*n* is respectively coupled to a corresponding one of feedback lines 418*a*, 418*b*, . . . , 418*n* of primitives 450*a*–450*n*. The output of each feedback amplifier 406*a*–406*n* is respectively coupled to a corresponding one of FET drive lines 416*a*, 416*b*, . . . , 418*n* of primitives 450*a*–450*n*.

Figure 10:
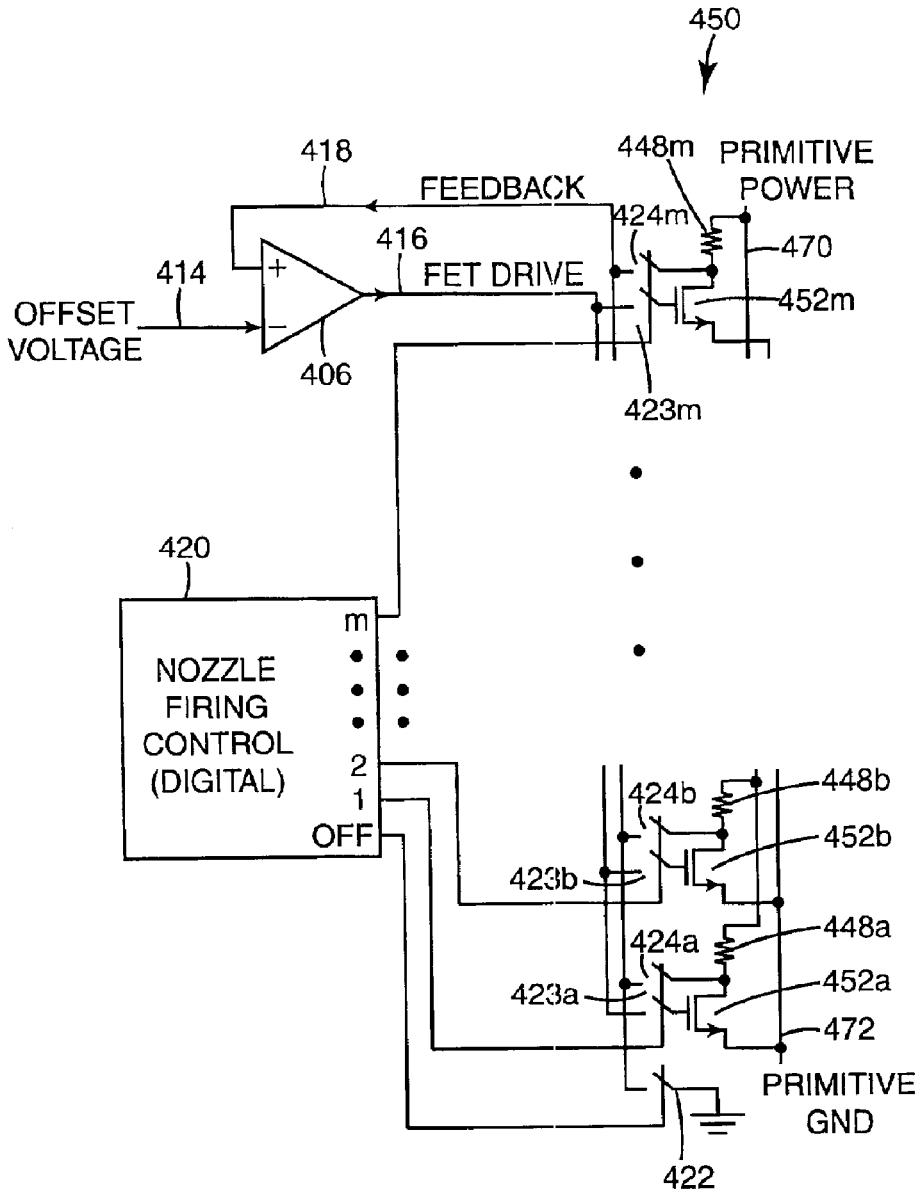
FIG. 10 is a block and schematic diagram illustrating portions of one embodiment of a primitive of the inkjet printhead of FIG. 9.

Portions of one embodiment of a primitive 450 of printhead 440 are generally illustrated in block and schematic diagram form in FIG. 10. Primitive 450 includes at most M firing resistors 448*a*, 448*b*, . . . , 448*m*. Each firing resistor 448 has a first terminal coupled to primitive power line 470. Primitive 450 includes at most M power FETs 452*a*, 452*b*, . . . , 452*m*. Each power FET 252 has its source coupled to primitive ground line 472 and its drain coupled to a second terminal of a corresponding firing resistor 448.

A digital nozzle firing controller 420 has M outputs for controlling at least M pairs of analog switches (423*a*, 424*a*), (423*b*, 424*b*), . . . , (423*m*, 424*m*). In addition, nozzle firing controller 420 has an off output, which when activated controls a switch 422 to disable all firing resistors 448 in primitive 450. The N other outputs of nozzle firing controller 420 are operated with a digital state machine or other suitable logic so that at most only one of the M outputs are active at a given time so that at most only one switch pair (423, 424) is switched on at a given time. Switches 422, 423, and 424 can be implemented with low-impedance non-power FETs.

Each switch 423 is coupled between a control gate of a corresponding power FET 452 and the FET drive line 416 provided as the output of feedback amplifier 406. Each switch 424 is coupled between the second terminal of a corresponding firing resistor 448 and the feedback line 418 provided to the positive input of feedback amplifier 406.

Thus, in operation, when nozzle firing controller 420 selects a switch pair (423, 424) to be turned on, the FET drive line 416 is coupled to the control gate of the corresponding selected power FET 452 and the feedback line 418 is coupled to the second terminal of the corresponding selected firing resistor 448 and to the drain of the selected power FET 452. This feedback configuration between the selected power FET 452 and feedback amplifier 406 provides the offset voltage 414 on feedback line 418 to the second terminal of the selected firing resistor 448. Since, the selected firing resistor 448 also has the primitive power line coupled to its first input, the selected firing resistor is energized and electrical current is passed through the firing resistor to heat the ink in a corresponding selected vaporization chamber.

Only one resistor 448 inside of each primitive 450 can be energized at a given time. An energized firing resistor 448 in a given primitive 450 has the offset voltage coupled to its low-side instead of the internal power ground 496 and the internal Vpp power supply path 492 coupled to its high-side. Since the high-side of the energized firing resistor 448 is coupled to the internal Vpp power supply path 492, the energized firing resistor 448 has a constant voltage across it equal to a difference of the Vpp voltage and the programmed offset voltage even if the Vpp voltage sags. This tracking of Vpp voltage movement results in a substantially constant power being delivered to the energized firing resistors 448 in printhead 440.

The linear power regulator 300/400 of printhead 340/440 permits a fixed applied power to the energized firing resistors 48/448 and a fixed duration for which the applied power is applied to the energized firing resistors 48/448. In this way, the amount of power delivered to the firing resistors is kept to at a substantially constant level, even when only a few firing resistors are energized at a given time. The reduced power variation increases the firing resistor life, which thereby yields a longer life for the printhead 40/440.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printhead comprising:

a plurality of address leads;

at least one data lead; and a plurality of primitives each comprising a group of drop generators, each primitive coupled to at least some of the plurality of address leads and the at least one data lead, wherein signals are provided on the plurality of address leads so that one drop generator in a primitive ejects ink at a time, wherein a number of the plurality of primitives is at least ten times greater then a number of the plurality of address leads;

wherein each drop generator includes a firing resistor having a resistance value in a range from approximately 800 ohms to approximately 1000 ohms.

2. An inkjet printhead comprising:

a plurality of address leads;

at least one data lead; and a plurality of primitives each comprising a group of drop generators, each primitive coupled to at least some of the plurality of address leads and the at least one data lead, wherein signals are provided on the plurality of address leads so that one drop generator in a primitive ejects ink at a time, wherein a number of the plurality of primitives is at least ten times greater than a number of the plurality of address leads, and further comprising:

a substrate having a first ink feed slot formed in the substrate, wherein the first ink feed slot has a first side and second side along a length of the first ink feed slot;

wherein a first column of drop generators is formed along the first side of the first ink feed slot;

wherein a second column of drop generators is formed along the second side of the first ink feed slot;

a second ink feed slot formed in the substrate, wherein the second ink feed slot has a first side and second side along a length of the second ink feed slot;

wherein a third column of drop generators is formed along the first side of the second ink feed slot;

wherein a fourth column of drop generators is formed along the second side of the second ink feed slot;

wherein each drop generator includes a nozzle, and nozzles within each column of drop generators have a vertical pitch of at least approximately 600 nozzles per inch; and wherein nozzles within the first and second columns of drop generators are vertically offset from nozzles within the third and fourth columns of drop generators by approximately $1/2400$ inch.

3. An inkjet printhead comprising:

a plurality of address leads;

at least one data lead; and a plurality of primitives each comprising a group of drop generators, each primitive coupled to at least some of the plurality of address leads and the at least one data lead, wherein signals are provided on the plurality of address leads so that one drop generator in a primitive ejects ink at a time, wherein a number of the plurality of primitives is at least ten times greater than a number of the plurality of address leads;

wherein each drop generator includes a firing resistor, and wherein a total scan axis stagger from an innermost firing resistor in each column of drop generators to an outermost firing resistor in each column of drop generators is approximately 19.4 micrometers.

4. An inkjet printhead comprising:

a plurality of address leads;

at least one data lead; and a plurality of primitives each comprising a group of drop generators, each primitive coupled to at least some of the plurality of address leads and the at least one data lead, wherein signals are provided on the plurality of address leads so that one drop generator in a primitive ejects ink at a time, wherein a number of the plurality of primitives is at least ten times greater than a number of the plurality of address leads wherein each drop generator comprises a firing resistor, the ink jet printhead further comprising:

an internal power supply path;

a power regulator providing an offset voltage from a voltage of the internal power supply path voltage;

wherein each primitive includes a corresponding group of switches controllable to couple a selected firing resistor between the internal power supply path and the offset voltage to thereby permit electrical current to pass through the selected firing resistor.

5. An inkjet printhead comprising:

a plurality of address leads;

at least one data lead; and a plurality of groups of resistors, each group coupled to at least some of the plurality of address leads and the at least one data lead, wherein the plurality of address leads provide signals so that one resistor in each group of resistors conducts current at a time, wherein a number of the plurality of groups is at least ten times greater than a number of the plurality of address leads;

wherein each resistor has a resistance value in a range from approximately 800 ohms to approximately 1000 ohms.

6. An inkjet printhead comprising:

a plurality of address leads;

at least one data lead; and a plurality of groups of resistors, each group coupled to at least some of the plurality of address leads and the at least one data lead, wherein the plurality of address leads provide signals so that one resistor in each group of resistors conducts current at a time, wherein a number of the plurality of groups is at least ten times greater than a number of the plurality of address leads, further comprising:

a substrate having a first ink feed slot formed in the substrate, wherein the first ink feed slot has a first side and second side along a length of the first ink feed slot;

wherein a first column of resistors is formed along the first side of the first ink feed slot;

wherein a second column of resistors is formed along the second side of the first ink feed slot;

a second ink feed slot formed in the substrate, wherein the second ink feed slot has a first side and second side along a length of the second ink feed slot;

wherein a third column of resistors is formed along the first side of the second ink feed slot;

wherein a fourth column of resistors is formed along the second side of the second ink feed slot;

wherein each resistor is utilized to eject ink from a corresponding nozzle, and nozzles corresponding to each column of resistors have a vertical pitch of at least approximately 600 nozzles per inch; and wherein nozzles corresponding to the first and second columns of resistors are vertically offset from nozzles corresponding to the third and fourth columns of drop generators by approximately $\frac{1}{2400}$ inch.

7. An inkjet printhead comprising:

a plurality of address leads;

at least one data lead; and a plurality of groups of resistors, each group coupled to at least some of the plurality of address leads and the at least one data lead, wherein the plurality of address leads provide signals so that one resistor in each group of resistors conducts current at a time, wherein a number of the plurality of groups is at least ten times greater than a number of the plurality of address leads, further comprising:

an internal power supply path;

a power regulator providing an offset voltage from a voltage of the internal power supply path voltage;

wherein each group includes a corresponding group of switches controllable to couple a resistor between the internal power supply path and the offset voltage to thereby permit electrical current to pass through the selected resistor.

8. An inkjet printhead assembly comprising:

at least one printhead, each printhead including:

an address having M possible address values; end

N primitives, each primitive including:

a group of at most M drop generators, wherein the address is cycled through all M address Values to control a sequence of which one drop generator in the primitive is fired at a given time, wherein one drop generator in the primitive can be fired simultaneously with one drop generator in each of the other primitives, wherein a primitive to address ratio (N/M) of the printhead is at least 10 to 1, wherein each drop generator includes a firing resistor having a resistance value in a range from approximately 800 ohms to approximately 1000 ohms.

9. An inkjet assembly comprising:

at least one printhead, wherein each printhead has an operating voltage of at least approximately 30 volts, each printhead including:

an address having M possible address values; and

N primitives, each primitive including:

a group of at most M drop generators, wherein the address is cycled through all M address values to control a sequence of which one drop generator in the primitive is fired at a given time, wherein one drop generator in the primitive can be fired simultaneously with one drop generator in each of the other primitives, wherein a primitive to address ratio (N/M) of the printhead is at least 10 to 1, wherein each drop generator includes a firing resistor having a resistance value in a range from approximately 800 ohms to approximately 1000 ohms.

10. An inkjet assembly comprising:

at least one printhead, each printhead including:

an internal power supply path;

a power regulator providing an offset voltage from the internal power supply path voltage;

N primitives, each primitive including:

a group of at most M drop generators, wherein the address is cycled through all M address values to control a sequence of which one drop generator if the primitive is fired at a given time, wherein one drop generator in the primitive can be fired simultaneously with one drop generator in each of the other primitives, wherein a primitive to address ratio (N/M) of the printhead is at least 10 to 1, wherein each drop generator includes a firing resistor having a resistance value in a range from approximately 800 ohms to approximately 1000 ohms; and a corresponding group of switches controllable to couple a selected firing resistor between the internal power supply path and the offset voltage to thereby permit electrical current to pass through the selected firing resistor to cause a corresponding selected drop generator to fire.

11. An inkjet printhead comprising:

a plurality of address leads;

at least one data lead; and a plurality of groups of resistors, each group coupled to at least two of the plurality of address leads and the at least one data lead, wherein the at least two of address leads provide signals so that one resistor in a group of resistors conducts current at a time, wherein a number of the plurality of groups is at least ten times greater than a number of the plurality of address leads;

wherein each resistor has a resistance value in a range from approximately 800 ohms to approximately 1000 ohms.

* * * * *

UNITED STATES PATENT AND TRADEMARK OFFICE

CERTIFICATE OF CORRECTION

PATENT NO. : 6,932,453 B2
APPLICATION NO. : 09/999355
DATED : August 23, 2005
INVENTOR(S) : James A. Feinn et al.

It is certified that error appears in the above-identified patent and that said Letters Patent is hereby corrected as shown below:

In column 14, line 38, delete “9.83–11.74” and insert -- 9.82–11.74 --, therefor.

In column 19, line 51, in Claim 1, delete “then” and insert -- than --, therefor.

In column 21, line 64, in Claim 8, delete “end” and insert -- and --, therefor.

In column 21, line 67, in Claim 8, delete “Values” and insert -- values --, therefor.

In column 22, line 36, in Claim 10, after “generator” delete “if” and insert -- in --, therefor.

Signed and Sealed this

Twenty-eighth Day of July, 2009

John Doll

JOHN DOLL
*Acting Director of the United States Patent and Trademark Office*